US005086548A

United States Patent [19]

Tanaka et al.

[11] Patent Number: 5,086,548

[45] Date of Patent: Feb. 11, 1992

[54] BUCKLE DEVICE FOR SEATBELT SYSTEM

[75] Inventors: Kohbun Tanaka; Hiroshi Tsuge, both of Aichi, Japan

[73] Assignee: Kabushiki Kaisha Tokai-Rika-Denki-Seisakusho, Aichi, Japan

[21] Appl. No.: 578,285

[22] Filed: Sep. 6, 1990

[30] Foreign Application Priority Data

Sep. 11, 1989 [JP] Japan ..... 1-106301[U]

[51] Int. Cl.[5] ..... A44B 11/25

[52] U.S. Cl. ..... 24/632; 24/573.5; 24/664

[58] Field of Search ..... 24/632, 642, 633, 656, 24/664, 573.5, 602, 603

[56] References Cited

U.S. PATENT DOCUMENTS

| | | | |
|---|---|---|---|
| 3,473,201 | 10/1969 | Hopka et al. | 24/632 |
| 3,523,342 | 8/1970 | Spires | 24/632 |
| 3,605,207 | 9/1971 | Glauser et al. | 24/632 |
| 3,825,979 | 7/1974 | Jakob | 24/573.5 |

FOREIGN PATENT DOCUMENTS

| | | | |
|---|---|---|---|
| 8505258 | 12/1985 | European Pat. Off. | 24/664 |
| 61-37107 | 2/1986 | Japan . | |
| 1448317 | 9/1976 | United Kingdom | 24/573.5 |

*Primary Examiner*—Victor N. Sakran

*Attorney, Agent, or Firm*—Sixbey, Friedman, Leedom & Ferguson

[57] ABSTRACT

A buckle device for a car seatbelt system is used together with a plurality of tongue plates to which occupant securing webbings are connected. Lock members for engaging the tongue plates are released upon operating a single release button. The shifting direction of the release button is confined in a plane defined by the insertion directions of the tongue plates. The operation force of the release button is transmitted to the lock members via a mechanism for example cam-contact or link mechanism. Therefore, the operation necessary for a passenger at the time of release is only to push the release button. There is no need to hold or pinch the buckle device at any time.

21 Claims, 7 Drawing Sheets

BUCKLE DEVICE FOR SEATBELT SYSTEM

BACKGROUND OF THE INVENTION

1. Field of the Invention

This invention relates to a buckle device of a car seatbelt system which is controlled by a passenger when fastening a webbing.

2. Background Information

A conventional buckle device is designed such that a single tongue plate is inserted thereinto to obtain an engaged state.

When a plurality of webbings or belts are used, a corresponding plurality of tongue plates are made insertable into buckle devices (see, Japanese Patent Application Laid-Open No. 61-37107).

With this type of buckle device, a pair of tongue plates is inserted into a buckle body in a crossing mode to obtain an engaged state. To release the tongue plates from the engaged state, a release button must be pushed by the occupant in the thicknesswise direction of the buckle body that is orthogonal to the insertion direction of the tongue plates. Thus, the release button must be operated with a large operational force while holding the buckle body between the fingers.

SUMMARY OF THE INVENTION

It is an object of the present invention to provide a buckle device capable of engaging a plurality of tongue plates which is configured so that the tongue plates can be readily released from an engaged state.

A buckle device according to the present invention includes a release button made movable in a plane defined by the insertion directions of the tongue plates, and when pushed, releases the tongue plates from their engaged state. A cam-contact mechanism, a link mechanism, or the like is used to transmit a force from the release button to lock members for engaging the tongue plates.

Specifically, the moving direction of the release button is confined in the plane defined by the insertion directions of the tongue plates; therefore, only upon pushing the release button with a finger, the tongue plates are disengaged. Generally, a buckle body is supported to a vehicle body in such a manner that the buckle body can bear the reactive force of the insertion of the tongue plates; therefore, the tongue plates can be inserted in the buckle body without the need to hold the buckle body by hand. This is also effective when pushing/moving the release button to release the tongue plates, that is, the buckle body can bear the reaction of moving the release button without the need to hold the buckle body in ones hand.

DESCRIPTION OF THE PREFERRED EMBODIMENTS

Figure 1:
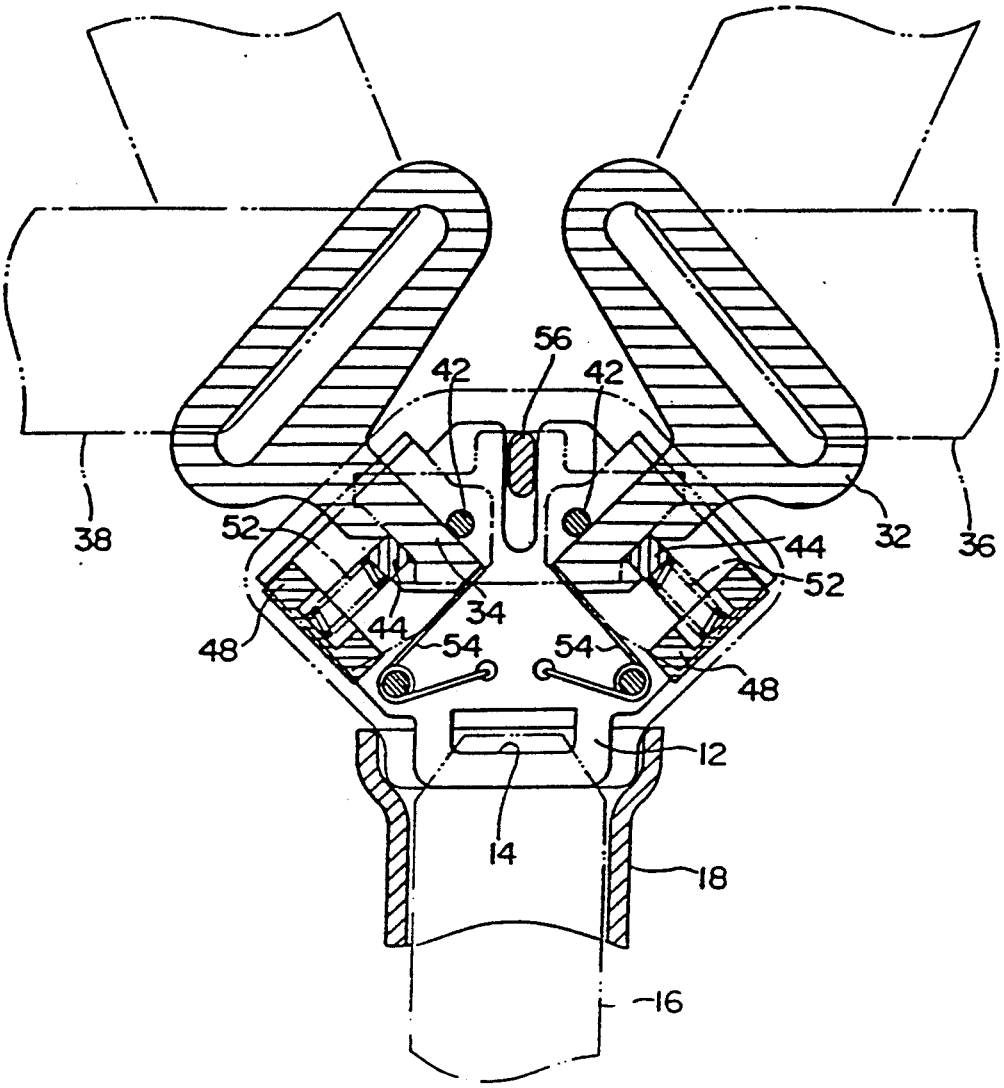
FIG. 1 is a sectional view showing a first embodiment of a buckle device according to the present invention, in which tongue plates are in an engaged state.
Figure 2:
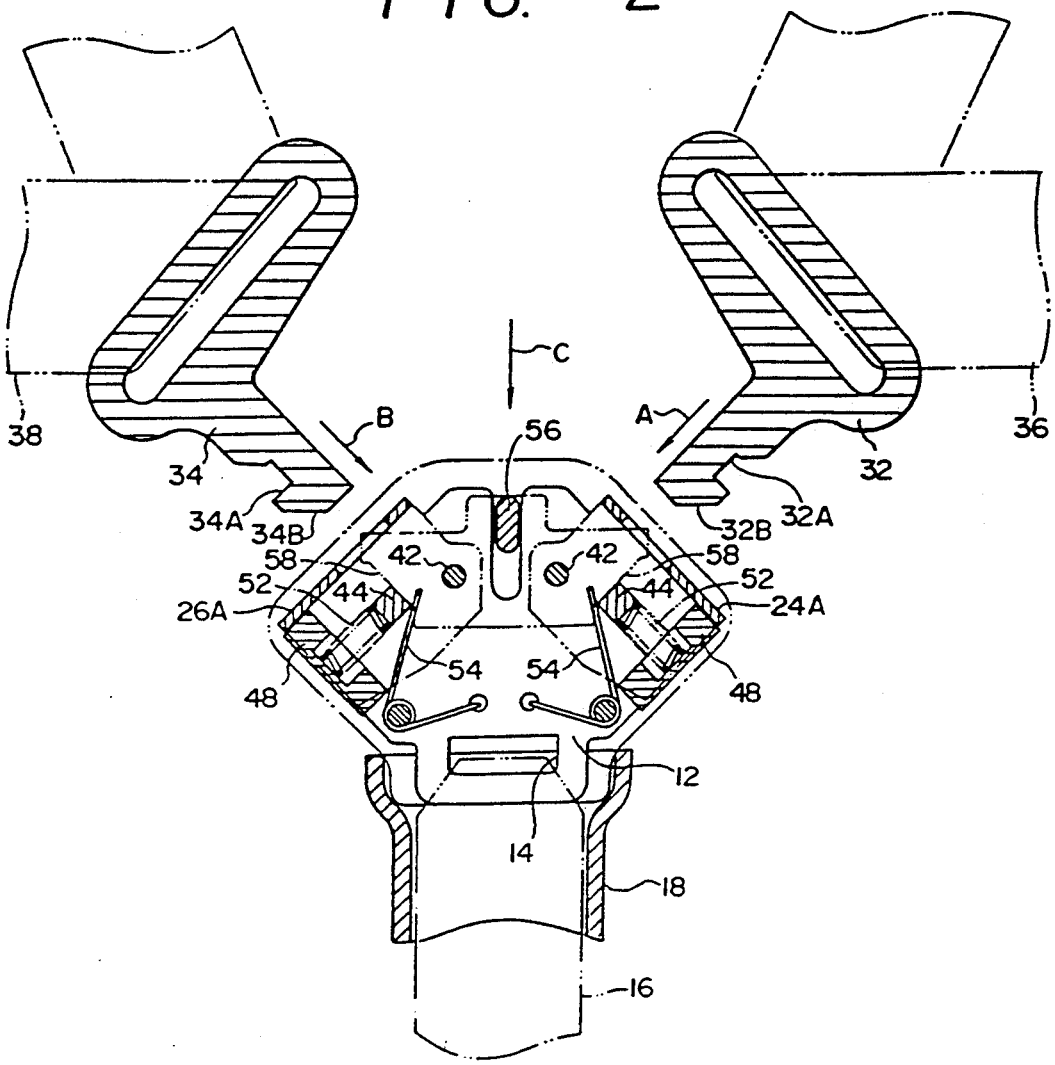
FIG. 2 is a sectional view similar to FIG. 1, in which the tongue plates are in a released state.
Figure 3:
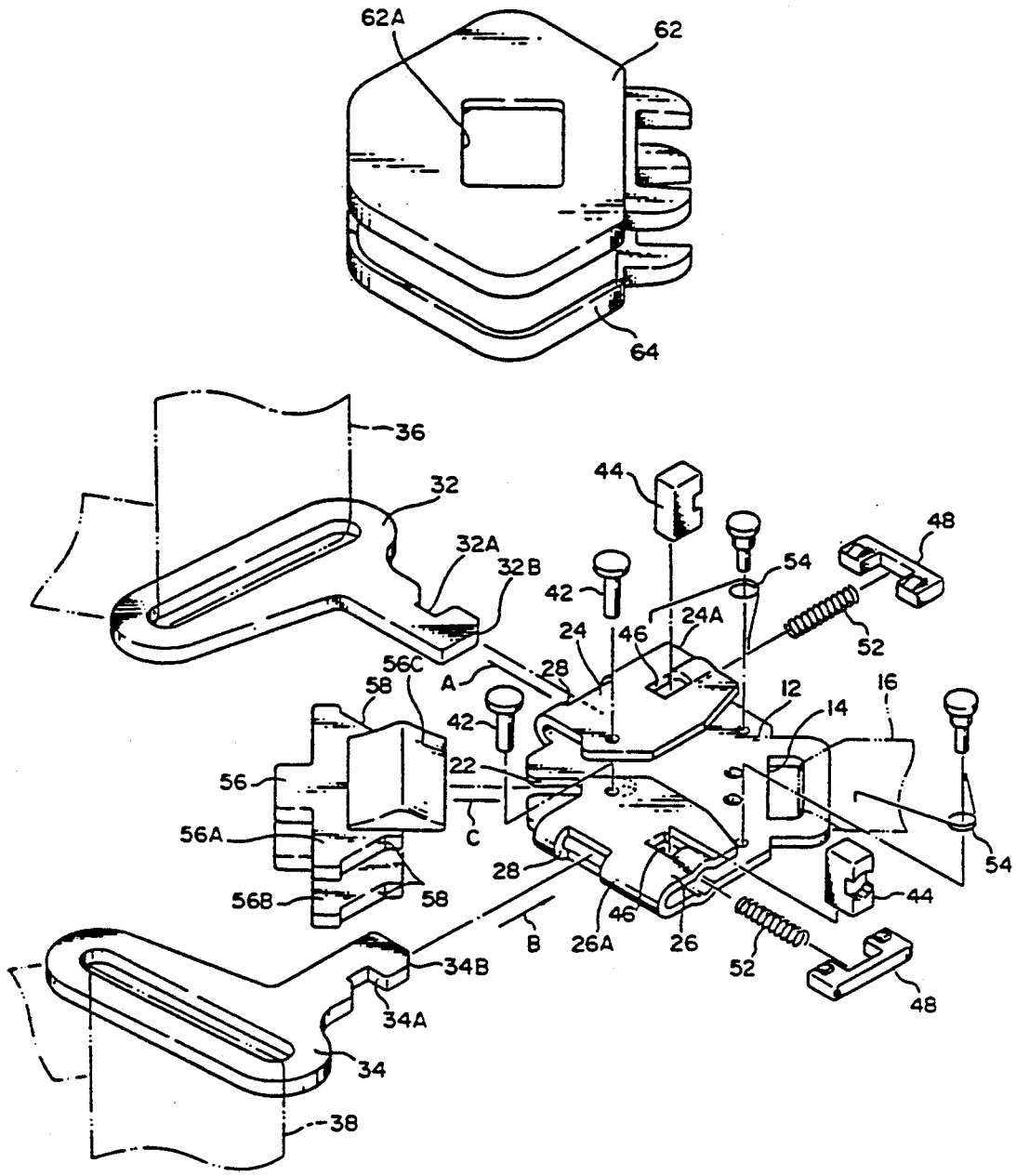
FIG. 3 is an exploded perspective view showing the first embodiment.

FIGS. 1 through 3 show a first embodiment of the present invention in which tongue plates are released by the use of a cam.

In a buckle device of this embodiment, a plate-shaped buckle body 12 has a support opening 14 formed in an end portion thereof, which serves as an attaching portion of an attaching strap 16 secured to a body of a vehicle (not shown). Provided around the periphery of the attaching strap 16 is a sleeve-shaped cover 18 having a certain rigidity. The buckle device is disposed in the inside the car cabin in an upright position. The attaching strap 16 itself may also be made from a rigid support material.

As seen in FIG. 3, the buckle body 12 has a slit 22 formed in an end portion thereof opposite to the support opening 14, which extends substantially orthogonal to the wise direction of the support opening 14. Portions of the buckle body 12 between the slit 22 and the support opening 14 spread radially from the vicinity of the support opening 14 to define extension portions 24 and 26. These extension portions 24 and 26 are folded back, leaving curved upright portions 24A and 26A, and then extend parallel to the buckle body 12. Each of the curved portions 24A and 26A has an opening 28 formed therein through which tongue plates 32, 34 can be inserted, respectively. The tongue plates 32 and 34 are arranged symmetrically with respect to the slit 22, to which fastening webbings 36 and 38 are attached. Therefore, an occupant can put on the two fastening webbings 36 and 38 together.

Each of the tongue plates 32 and 34 is guided at one edge by a rivet 42 when it is inserted into the buckle body 12. The rivets 42 are included to secure the buckle body 12 and the extension portions 24, 26 together. Each of the tongue plates 32 and 34 has a notch 32A, 34A opposite to the rivet 42, into which a pair of lock bars 44 is fitted.

That is, the tongue plates 32 and 34 can be inserted into the buckle body 12 in the directions of the arrows A and B, respectively, that are angularly spaced from each other by an angle of about 90 degrees. To make the lock bars 44 movable orthogonally to the insertion directions of the tongue plates 32 and 34, guide holes 46 are formed in the extension portions 24 and 26 of the buckle body 12. Spring seats 48 are secured between the buckle body 12 and the extension portions 24 and 26, and compression springs 52 are interposed between the lock bars 44 and the spring seats 48, so that the lock bars 44 are urged in the directions in which they enter into the insertion paths of the tongue plates 32 and 34. Therefore, when the tongue plates 32 and 34 are inserted through the openings 28, the lock bars 44 are shifted in respective separating directions from the insertion paths of the tongue plates 32 and 34 by means of inclined surfaces 32B and 34B formed at the ends of the tongue plates 32 and 34. Then, by virtue of the urging force of the compression springs 52, the lock bars 44 are fitted in the notches 32A and 34A to keep the tongue plates 32 and 34 in an engaged state.

To urge the tongue plates 32 and 34 thus inserted in the buckle body 12 in respective ejection directions, torsion springs 54 are provided.

A slide release button 56 is movably fitted into the slit 22 of the buckle body 12. Specifically, the release button 56 is integrally molded from synthetic resin such that when it is moved along the middle line between the tongue plates 32 and 34 (in the direction of the arrow C) while being guided by the slit 22, the two tongue plates 32 and 34 are released from the engaged state. In this regard, the release button 56 has parallel extension portions 56A and 56B which pass along either surface of each of the tongue plates 32 and 34 inserted and engaged. Each of the parallel extension portions 56A and 56B has an oblique surface 58 which is inclined at substantially 45 degrees in the insertion direction of the release button 56. Therefore, when the release button 56 is pushed in the direction of the arrow C, each oblique surface 58 shifts the corresponding lock bar 44 through a cam-contact action in opposition to the urging force of the compression coil spring 52. The angle of inclination of the oblique surface 58 may be changed such that the lock bar 44 is pushed by a force stronger than that applied to the release button 56.

As shown in FIG. 3, the buckle body 12 is enclosed by an upper cover 62 and a lower cover 64 connected together, and a control portion 56C of the release button 56 projects through an opening 62A formed in the upper cover 62, which is controlled by the occupant.

The operation of the embodiment will be described.

When the passenger inserts the tongue plates 32 and 34 through the corresponding openings 28, the lock bars 44 are engage with the notches 32A and 34A by virtue of the urging force of the compression coil springs 52, so that the tongue plates 32 and 34 are held in an engaged state. At this time, since the buckle body 12 is held in the upright position on the body by means of the attaching strap 16 and the cover 18, it is not necessary to hold the buckle body 12 by fingers or the like during the insertion operation of the tongue plates 32 and 34 in the directions of the arrows A and B. That is, the reaction of insertion is surely borne by the attaching strap 16 and the cover 18, this eliminating the need to apply any supporting force to the buckle body 12.

On the other hand, when wanting to release the fastening webbings 36 and 38, the occupant pushes the release button 56 in the direction of the arrow C. Consequently, the oblique surfaces 58 of the release button 56 engages with the lock bars 44 to push the lock bars 44 out of the notches 32A and 34A, so that the lock bars 44 are removed from the moving paths of the tongue plates 32 and 34 and thus the tongue plates 32 and 34 are released from their engaged state. In this case, since the reaction of the moving of the release button 56 pushed in the direction of the arrow C is borne by the attaching strap 16 and the cover 18 as is the case of the insertion operation of the tongue plates 32 and 34, the operation needed for the passenger is only to push the release button 56 in the direction of the arrow C and it is not necessary to hold or grip the buckle body 12.

Figure 4:
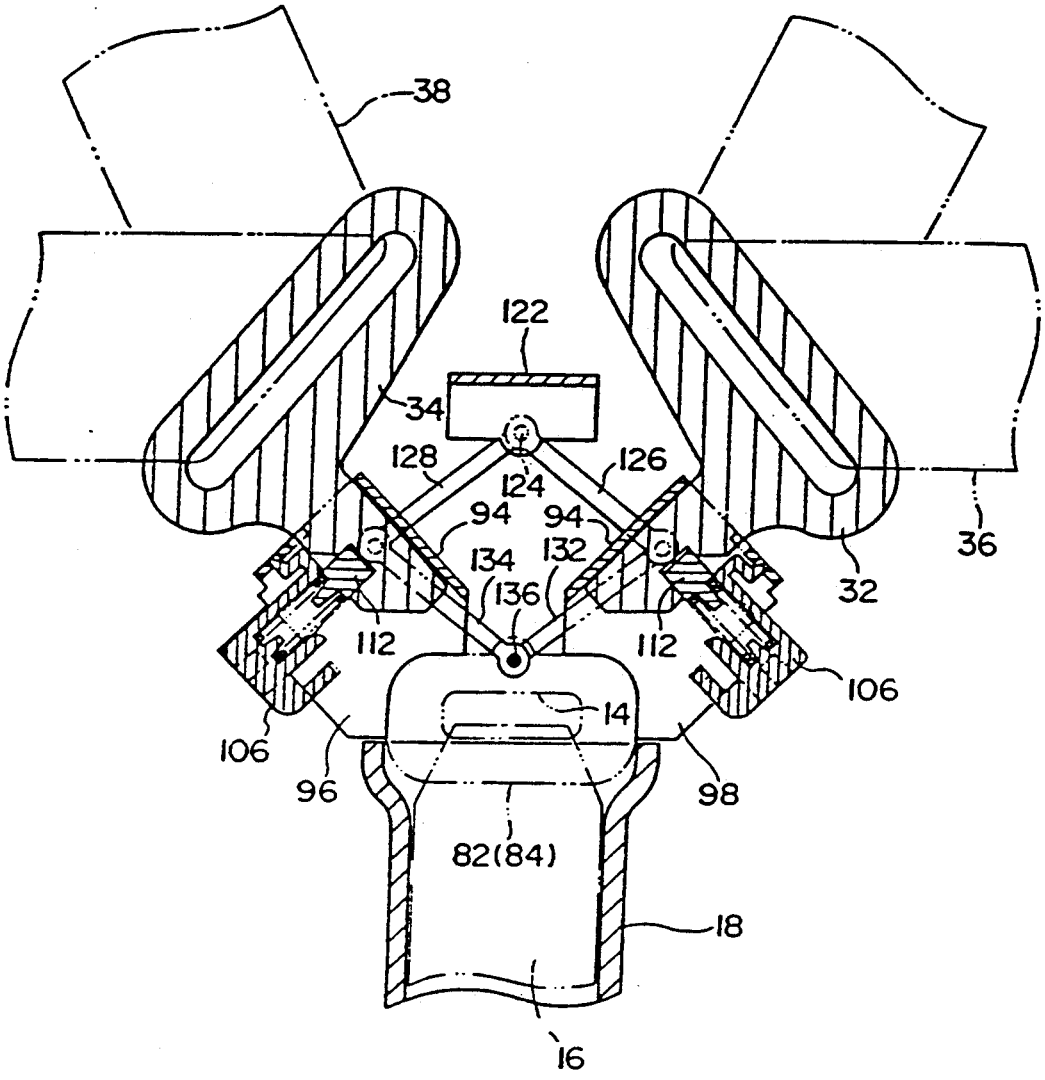
FIG. 4 is a sectional view showing a second embodiment of the buckle device, in which the tongue plates are in the engaged state.
Figure 5:
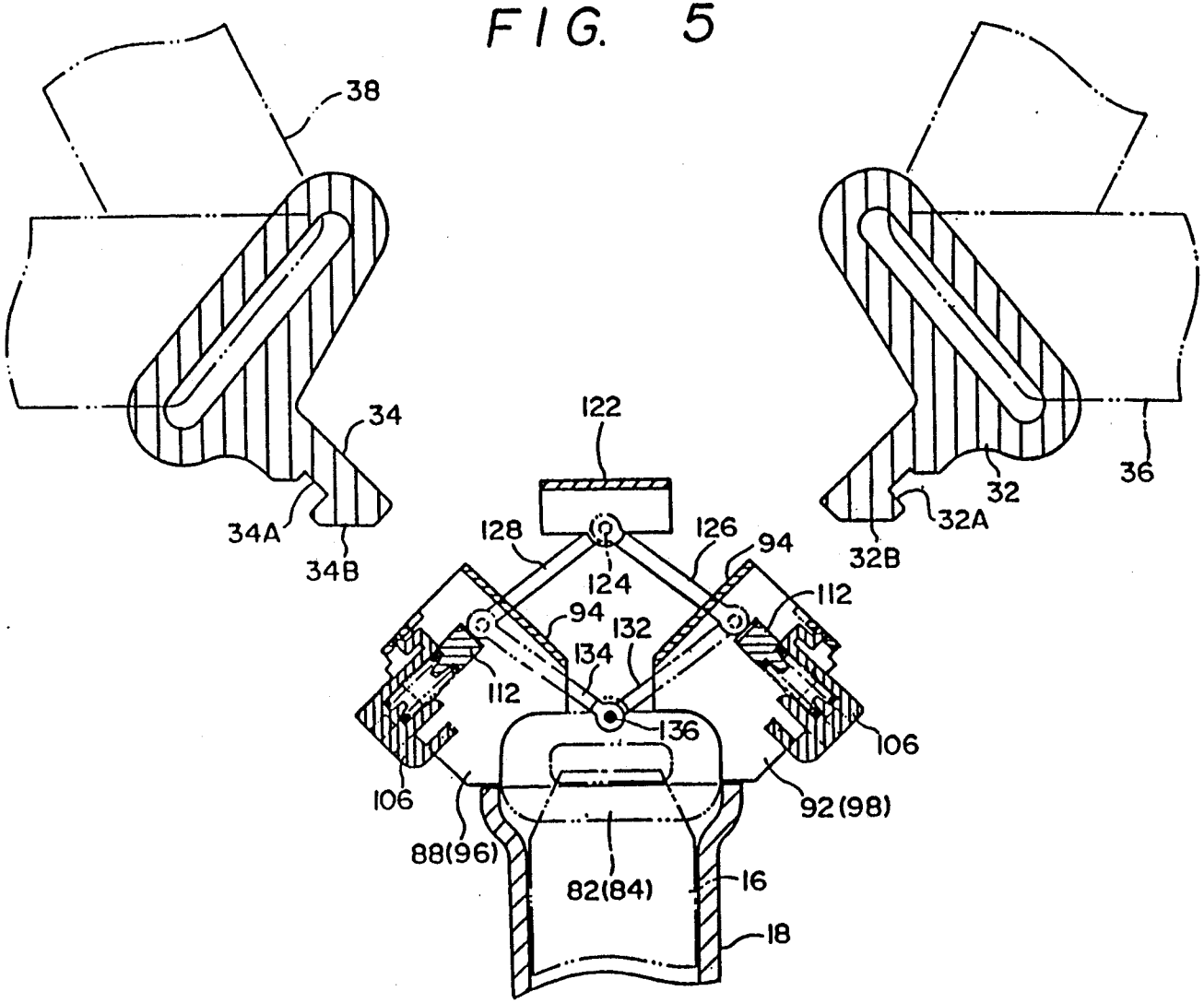
FIG. 5 is a sectional view similar to FIG. 4, in which the tongue plates are in the released state.
Figure 6:
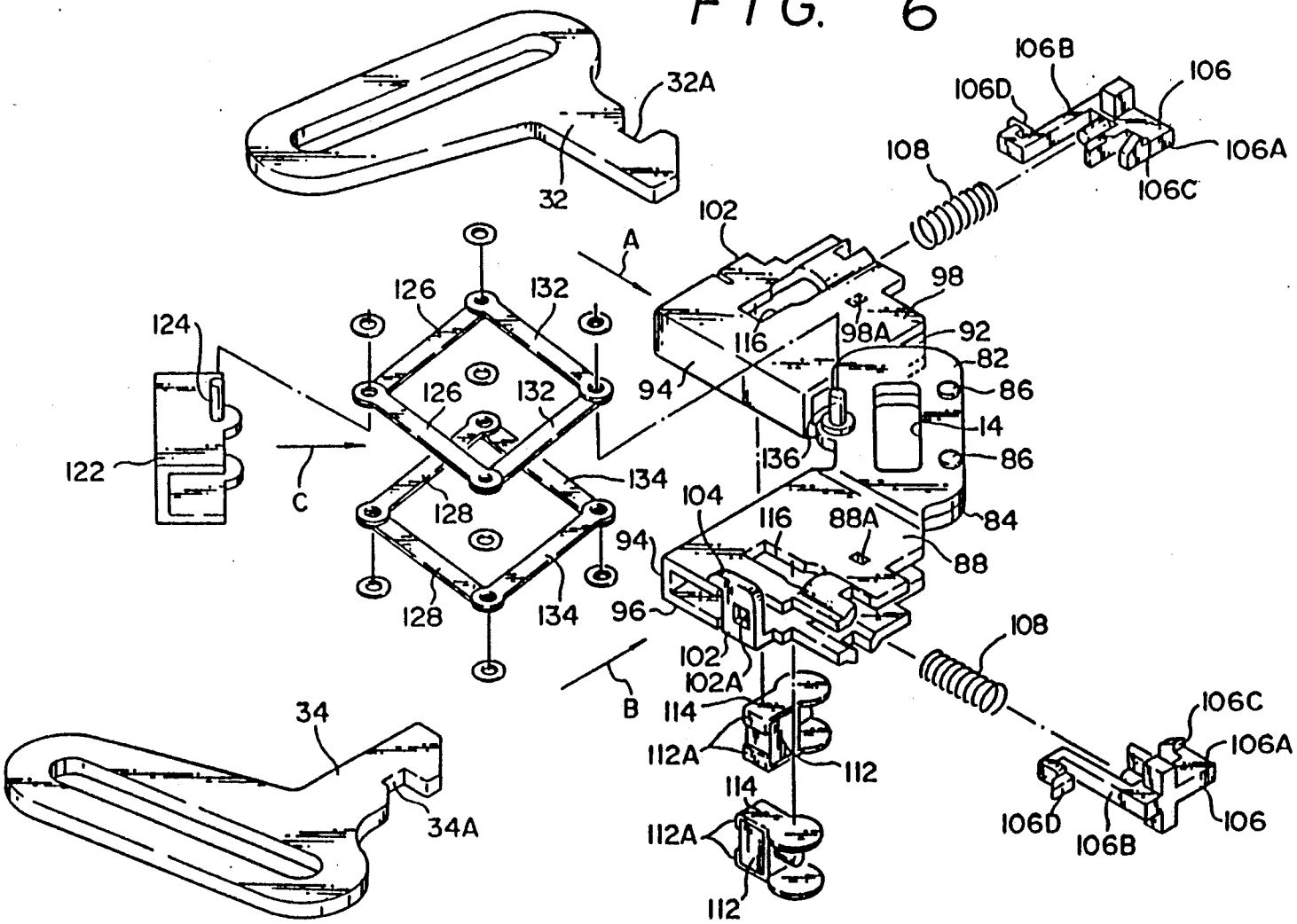
FIG. 6 is an exploded perspective view showing the second embodiment.

FIGS. 4 through 6 shows a second embodiment of the present invention in which tongue plates are released by the use of a link mechanism.

In this embodiment, a pair of buckle bodies 82 and 84 is superposed and secured together by rivets 86, and the superposed section of the buckle bodies 82 and 84 has a support opening 14 formed therein.

Each buckle body 82, 84 has a radially-extending base extension portion 88, 92, a curved portion 94, and a folded-back parallel extension portion 96, 98 which is parallel to the corresponding base extension portion 88, 92. Each parallel extension portion 96, 98 has a folded engaging piece 102 at an edge portion thereof, and each folded engaging piece 102 has a fastening piece 104 at the end thereof which is designed to abut on the outer surface of the base extension portion 88, 92, so that the parallel extension portion 96, 98 and the base extension portion 88, 92 are prevented from coming apart from each other by means of the folded engaging portion 102 with the fastening piece 104.

The space between the folded engaging pieces 102 and the curved portions 94 defines insertion portions for the tongue plates 32, 34. The insertion directions (of the arrows A and B) are arranged so as to cross each other in the combination of buckle bodies 82 and 84 as in the case of the first embodiment.

Spring seats 106 are secured between the base extension portions 88, 92 and the parallel extension portions 96, 98. Compression coil springs 108 are interposed between the spring seats 106 and lock bars 112 such that the lock bars 112 are fitted into notches 32A, 34A of the tongue plates 32, 34. The lock bars 112 are combined integrally with a holder 114. The holders 114 are slidably received into openings 116 formed in the base extension portions 88, 92 and in the parallel extension portions 96, 98 so that the lock bars 112 can move smoothly. The lock bars 112 are made from metal to so as to have a large supporting force.

The spring seats 106 have hook portions 106C and 106D formed integrally in the arm portions 106A and 106B thereof. These hook portions 106C and 106D are resiliently engaged in openings 88A and 102A formed in the extension portions 88, 96, 92, 98 and in the folded engaging pieces 102 to retain the spring seats 106.

A release button 122 is disposed so as to shift in the direction of the arrow C or along the middle line between the directions of the arrows A and B. In this embodiment, the release button 122 is formed into a sectionally U-shaped plate, which has pins 124 projecting coaxially in opposite directions. One end of each of the pair of links 126 and 128 is pivotally supported by the pins 124. The other ends of these links 126 and 128 are pivotally supported to one of the ends of links 132 and 134. The other ends of the links 132 and 134 are pivotally supported by a rivet 136 provided upright on the buckle bodies 82 and 84.

The links 126, 128, 132 and 134 are all the same length, thus defining a parallelogram. The pivot sections of the links 126 and 132 and the links 128 and 138 correspond to protruding portions 112A of the lock bars 112 supported by the extension portions 88, 92, 96 and 98.

Therefore, when the release button 122 is pushed in the direction of the arrow C, two opposite vertexes of the parallelogram corresponding to the pins 124 and the rivet 136 approach each other and the other two opposite vertexes separate from each other; therefore, the lock bars 112 are moved in opposition to the urging force of the compression coil springs 108 to come out of engagement with the tongue plates 32, 34.

Figure 7:
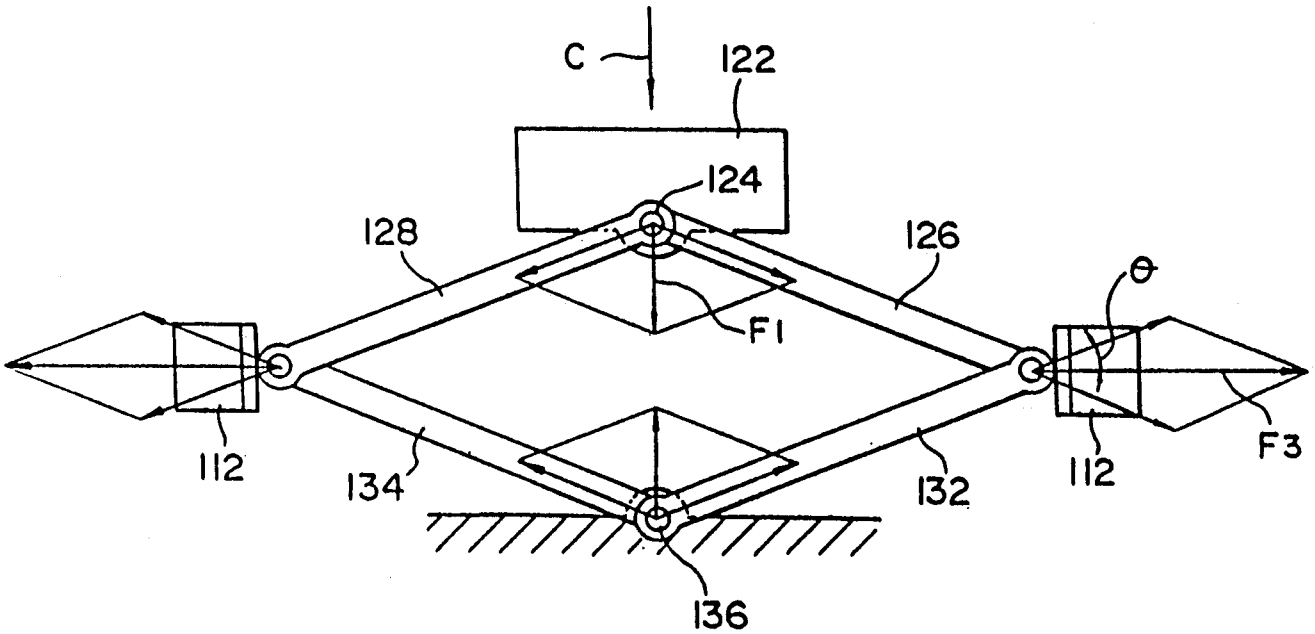
FIG. 7 is a schematic front view showing a link mechanism used in the second embodiment.

FIG. 7 schematically shows the relationship between the pushing force of the release button 122 and the operating force applied from the links 126, 128, 132, 134 to the lock bars 112. The illustrated parallel link mechanism forms a toggle boosting mechanism. Where the pushing direction (of the arrow C) of the release button 122 is orthogonal to the working direction of the operation force acting on the lock bars 112, when an angle $\theta$ corresponding to one-half of the interior angle between the links 126 and 132 is no greater than 45 degrees, the pushing operation force of the release button 122 is magnified and applied to the lock bars 112. That is, letting F1 be the operation force of the release button 122 and F3 be the working force acting on the lock bars 112, the following expression holds:

$$F3 = F1 \cot\theta \quad (1)$$

When the angle $\theta$ is 30 degrees, F3 becomes F1.7 times of F1, that is, the engaged state of the tongue plates 32, 34 can be released with a small operation force. In this embodiment, when the working direction of the working force F3 deviates from the moving direction of the lock bars 112, such a deviation causes some loss, resulting in some change in magnification.

In this embodiment, also, the operation direction (of the arrow C) of the release button 122 is confined in a plane defined by the insertion directions of the pair of tongue plates 32 and 34; therefore, if the attaching strap 16 and the cover 18 included in the first embodiment for bearing the reactive force of insertion of the tongue plates 32 and 34 are used in the second embodiment no additional means for bearing the reactive of operation is required, making it very easy to operate the buckle device.

What is claimed is:

1. A buckle device in which a plurality of tongue plates are inserted and engaged therein, comprising:

a buckle body supported to a vehicle body;

lock members being reciprocally movable between an engagement position and a disengagement position for the corresponding tongue plate in a plane defined by the insertion directions of the tongue plates and being supported in the buckle body which come into engagement with the corresponding tongue plates;

an urging means for urging the lock members to the engagement position; and a release button movable relative with respect to the buckle body, and being able to contact and to operate transversely with the lock members to bring the lock members out of engagement with the corresponding tongue plates, the relative movement of the release button being confined in the plane defined by the insertion directions of the tongue plates, whereby the lock members can be released through a sliding operation of the release button by an occupant.

2. A buckle device according to claim 1, wherein the release button is disposed between a pair of tongue plates which has respectively an inclined contact portion to operate the lock member, where the two tongue plates are in an engaged state with the lock members.

3. A buckle device according to claim 1, wherein the release button which has oppositely provided inclined contact portions to respectively operate the lock members is disposed midway between the insertion directions of a pair of tongue plates.

4. A buckle device according to claim 1, wherein the moving direction of the release button accords with the bisector direction between the insertion directions of a pair of tongue plates.

5. A buckle device according to claim 1, wherein the buckle body is supported to the vehicle body via a member that is rigid against a compressive force, whereby the reactive force of moving the release button caused by the occupant can be borne by the rigid member.

6. A buckle device according to claim 1, wherein the release button and the lock members are engaged in a camcontact mode, whereby the operation force of the release button is applied to the lock members equally.

7. A buckle device according to claim 1, wherein each lock member is engaged with one side of the corresponding tongue plate, the release button is disposed on the other side of the each tongue plate, and the release button when moved separates each lock member from the corresponding tongue plate to release the engaged state of the tongue plates.

8. A buckle device according to claim 1, wherein the buckle body has two flat portions parallel which are connected to each other via a curved portions, each tongue plate being received between the flat portions.

9. A buckle device according to claim 8, wherein each curved portion has an opening formed therein through which the corresponding tongue plate is inserted.

10. A buckle device according to claim 8, wherein each flat portion has a through hole formed therein in which the corresponding lock member is received in a load bearing manner.

11. A buckle device according to claim 8, wherein one of the pair of flat portions has a groove formed therein for guiding the release button.

12. A buckle device according to claim 1, further comprising a link mechanism disposed to the release button, wherein the operation force of the release button is transmitted to the lock member via the link mechanism.

13. A buckle device according to claim 12, wherein the link mechanism include links for transmitting the force of the release button to the lock members in directions crossing the direction of the operation force.

14. A buckle device according to claim 12, wherein the link mechanism includes links whose one ends move in the moving direction of the release button and the other ends in the moving directions of the lock members.

15. A buckle device according to claim 12, wherein the link mechanism includes a pair of release-button-side links and a pair of buckle-body-side links, one end of each of the two release-button-side links are pivotally supported via a shaft by the release button, one end of each of the two buckle-body-side links are pivotally supported via a shaft by the buckle body, and the other ends of the two release-button-side links and the other ends of the two buckle-body-side links are pivotally connected together.

16. A buckle device according to claim 15, wherein all the links are of the same length.

17. A buckle device for retaining two tongue plates with occupant fastening webbings connected thereto, comprising:

a buckle body supported to a body of a vehicle via a compressive force supporting member;

a plurality of paths for the insertion of a plurality of tongue plates which are formed in the buckle body in mutually crossing directions;

a plurality of lock bars being reciprocally movable between an engagement position and a disengagement position for the corresponding tongue plate in a plane defined by the insertion directions of the tongue plates and, being supported in the buckle body which come into engagement with notches of the tongue plates inserted to engage the tongue plates;

an urging means for urging the lock bar to the engagement position; and a release button movable, upon receipt of an operation force from an occupant, relative with respect to the buckle body and being able to contact and operate transversely with the lock bars to come into cam-like engagement with the two lock bars to thereby separate the lock bars from the notches of the tongue plates.

18. A buckle device according to claim 17, wherein the release button has cam-like engagement portions which come into cam-like engagement with each lock bar.

19. A buckle device for retaining a plurality of tongue plates to which occupant securing webbings are connected, comprising:

a buckle body supported to a body of a vehicle via a compressive force supporting member;

a plurality of paths for the insertion of each tongue plate which are formed in the buckle body in mutually crossing directions;

lock members being reciprocally movable between an engagement position and a disengagement position for the corresponding tongue plate in a plane defined by the insertion directions of the tongue plates and, being supported in the buckle body which come into engagement with notches of two tongue plates inserted to engage each tongue plate;

an urging means for urging the lock members to the engagement position;

a release button disposed movable in a direction midway between the insertion paths of the tongue plates in a plane defined by the insertion paths, which is pressing operation by a passenger; and a link mechanism inclusive of links for transmitting the pressing force of the release button to the lock members to transversely separate the lock members from the tongue plates, one end of each of the links being movable in the moving direction of the release button and another end in the separating direction of the lock members from the tongue plates.

20. A buckle device for retaining a plurality of tongue plates to which occupant securing webbings are connected, comprising:

a buckle body supported to a body of a vehicle via a compressive force supporting member;

a plurality of paths for the insertion of each tongue plate which are formed in the buckle body in mutually crossing directions;

lock members supported in the buckle body which come into engagement with notches of two tongue plates inserted to engage each tongue plate;

a release button disposed movable in a direction midway between the insertion paths of the tongue plates in a plane defined by the insertion paths, which is pressing operation by a passenger; and a link mechanism inclusive of links for transmitting the pressing force of the release button to the lock members to separate the lock members from the tongue plates, one end of each of the links being movable in the moving direction of the release button and another end in the separating direction of the lock members from the tongue plates wherein the link mechanism includes four links of identical length arranged in the form of a parallelogram.

21. A buckle device in which a plurality of tongue plates are inserted and engaged therein, comprising:

a buckle body supported to a vehicle body;

lock members being reciprocally movable between an engagement position and a disengagement position for the corresponding tongue plate in a plane defined by the insertion directions of the tongue plates and being supported in the buckle body which come into engagement with the corresponding tongue plates; and a release button movable relative with respect to the buckle body, and being able to contact and to operate transversely with the lock members to bring the lock members out of engagement with the corresponding tongue plates, the relative movement of the release button being confined in the plane defined by the insertion directions of the tongue plates.

* * * * *